US012369638B2

(12) United States Patent
Alford

(10) Patent No.: US 12,369,638 B2
(45) Date of Patent: Jul. 29, 2025

(54) SMOKELESS VAPORIZER DEVICE

(71) Applicant: James Alford, Bennettsville, SC (US)

(72) Inventor: James Alford, Bennettsville, SC (US)

( * ) Notice: Subject to any disclaimer, the term of this patent is extended or adjusted under 35 U.S.C. 154(b) by 356 days.

(21) Appl. No.: 17/830,456

(22) Filed: Jun. 2, 2022

(65) Prior Publication Data

US 2022/0386699 A1 Dec. 8, 2022

Related U.S. Application Data

(60) Provisional application No. 63/195,959, filed on Jun. 2, 2021.

(51) Int. Cl.

| | |
|---|---|
| ***A24F 40/10*** | (2020.01) |
| ***A24F 13/00*** | (2006.01) |
| ***A24F 40/40*** | (2020.01) |
| ***A24F 40/42*** | (2020.01) |
| ***A24F 40/48*** | (2020.01) |
| ***A24F 40/60*** | (2020.01) |

(52) U.S. Cl.
CPC ..... *A24F 40/48* (2020.01); *A24F 40/42* (2020.01); *A24F 40/60* (2020.01)

(58) Field of Classification Search
CPC ..... A24F 1/30; A24F 40/40; A24F 13/00
See application file for complete search history.

(56) References Cited

U.S. PATENT DOCUMENTS

| | | | | |
|---|---|---|---|---|
| 5,388,595 | A * | 2/1995 | Shafer | A24F 13/00 131/206 |
| 5,469,870 | A * | 11/1995 | Meador | A24F 13/00 131/202 |
| 2012/0272978 | A1* | 11/2012 | Wheeler | A24F 13/00 131/344 |
| 2016/0278429 | A1* | 9/2016 | Adamic | A24F 13/06 |
| 2017/0245545 | A1* | 8/2017 | Johnson, III | A61M 15/0021 |
| 2018/0116276 | A1* | 5/2018 | Prog | A24F 13/06 |
| 2019/0150516 | A1* | 5/2019 | Shenkal | A24F 40/485 |
| 2023/0329331 | A1* | 10/2023 | Woldemariam | A24F 40/20 |

FOREIGN PATENT DOCUMENTS

| | | | |
|---|---|---|---|
| WO | WO-2014067236 A1 * | 5/2014 | A24F 13/00 |

OTHER PUBLICATIONS

English Machine Translation of WO 2014/067236, obtained from PE2E Search (Clarivate Analytics) (Year: 2014).*

* cited by examiner

*Primary Examiner* — Philip Y Louie
*Assistant Examiner* — Charlotte Davison
(74) *Attorney, Agent, or Firm* — Brennan, Manna & Diamond, LLC

(57) ABSTRACT

The present invention relates to a smokeless vaporizer device primarily comprised of a housing with a transparent viewing window, a main reservoir, a CBD vape reservoir, at least one button, an inhale hose, an exhale hose, and at least one battery. The main reservoir and CBD vape reservoir can house cannabis and CBD products that can be vaporized via a heating element within the housing. The vapor can then be inhaled through the inhale hose by the user. After being inhaled, the user can then blow into the exhale hose to exhale the vapor back into the housing.

11 Claims, 3 Drawing Sheets

SMOKELESS VAPORIZER DEVICE

CROSS-REFERENCE TO RELATED APPLICATION

The present application claims priority to, and the benefit of, U.S. Provisional Application No. 63/195,959, which was filed on Jun. 2, 2021, and is incorporated herein by reference in its entirety.

FIELD OF THE INVENTION

The present invention relates generally to the field of vaporizers. More specifically, the present invention relates to a smokeless vaporizer device comprised of a housing having a transparent viewing window, a main reservoir, a CBD vape reservoir, at least one button, an inhale hose, an exhale hose, and at least one battery. The main reservoir and CBD vape reservoir can house cannabis and CBD products that can be vaporized via a heating element within the housing. The vapor can then be inhaled through the inhale hose by the user. After being inhaled, the user can then blow into the exhale hose to exhale the vapor back into the housing. Accordingly, the present disclosure makes specific reference thereto. Nonetheless, it is to be appreciated that aspects of the present invention are also equally applicable to other like applications, devices and methods of manufacture.

BACKGROUND

Standard methods of smoking can lead to unwanted odors in the form of secondhand smoke. As a result, individuals may not be able to enjoy their smoking session without worry of disturbing others with the odor of their smoke and the secondhand smoke it produces. Secondhand smoke can further be dangerous to other nearby non-smokers and cause serious illness.

Therefore, there exists a long-felt need in the art for an improved smoking device. Further, there exists a long-felt need in the art for a smokeless vaporizer device that eliminates secondhand smoke. In addition, there exists a long-felt need in the art for a smokeless vaporizer device that allows a user to smoke differing smoking substances from the same device.

The subject matter disclosed and claimed herein, in one embodiment thereof, comprises a smokeless vaporizer device. The device is primarily comprised of a housing with a transparent viewing window, a main reservoir, a CBD vape reservoir, at least one button, an inhale hose, an exhale hose, and at least one battery. The main reservoir and CBD vape reservoir can house cannabis and CBD products that can be vaporized via a heating element within the housing. The vapor can then be inhaled through the inhale hose by the user. After being inhaled, the user can then blow into the exhale hose to exhale the vapor back into the housing.

In this manner, the smokeless vaporizer device of the present invention accomplishes all of the foregoing objectives and provides an improved smoking device. Further, the smokeless vaporizer device eliminates secondhand smoke. Furthermore, the that allows a user to smoke differing smoking substances from the same device.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a smokeless vaporizer device. The device is primarily comprised of a housing with a transparent viewing window, a main reservoir, a CBD vape reservoir, at least one button, an inhale hose, an exhale hose, and at least one battery. The housing is further comprised of a main reservoir that may store any liquid or solid cannabis product, or any vaporizer juice known in the art within the reservoir or within at least one wax tube within the reservoir. The housing is further comprised of at least one transparent viewing window that allows a user to view the level of cannabis or vaporizer juice within the reservoir and/or wax tube. Further, the housing may be comprised of a CBD reservoir that may store any liquid or solid CBD product, or any CBD vaporizer juice known in the art within the reservoir or within at least one wax tube within the reservoir.

Any compound within the main reservoir and/or CBD reservoir may be heated by at least one heating element. The heating element is powered by a battery. The battery may be recharged by at least one charging port such as, but not limited to, any USB port type known in the art. To heat a compound, a user presses a heating button followed by pressing a CBD button to direct the heating element to heat a CBD compound within the CBD reservoir. Alternatively, a user may press a cannabis button to direct the heating element to heat a cannabis compound within the main reservoir. A fan button then allows the CBD compound or cannabis compound to be circulated through the device via at least one fan such that the vaporizer compound can be inhaled via the inhale hose.

The housing is further comprised of at least two rubber seals, wherein each seal may further be comprised of a scented filter to prevent the smell of CBD or cannabis from leaving the housing when the device is used. Each seal receives at least one inhale hose or at least one exhale hose. Both hoses have a mouthpiece that allows a user to inhale vaporizer compounds from the device and exhale said inhaled compounds back into the device via a mouthpiece such that the user produces no secondhand smoke.

Accordingly, the smokeless vaporizer device of the present invention is particularly advantageous as it provides an improved smoking device that eliminates secondhand smoke. In addition, the device allows a user to smoke differing smoking substances from the same device. In this manner, the smokeless vaporizer device overcomes the limitations of existing smoking devices known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
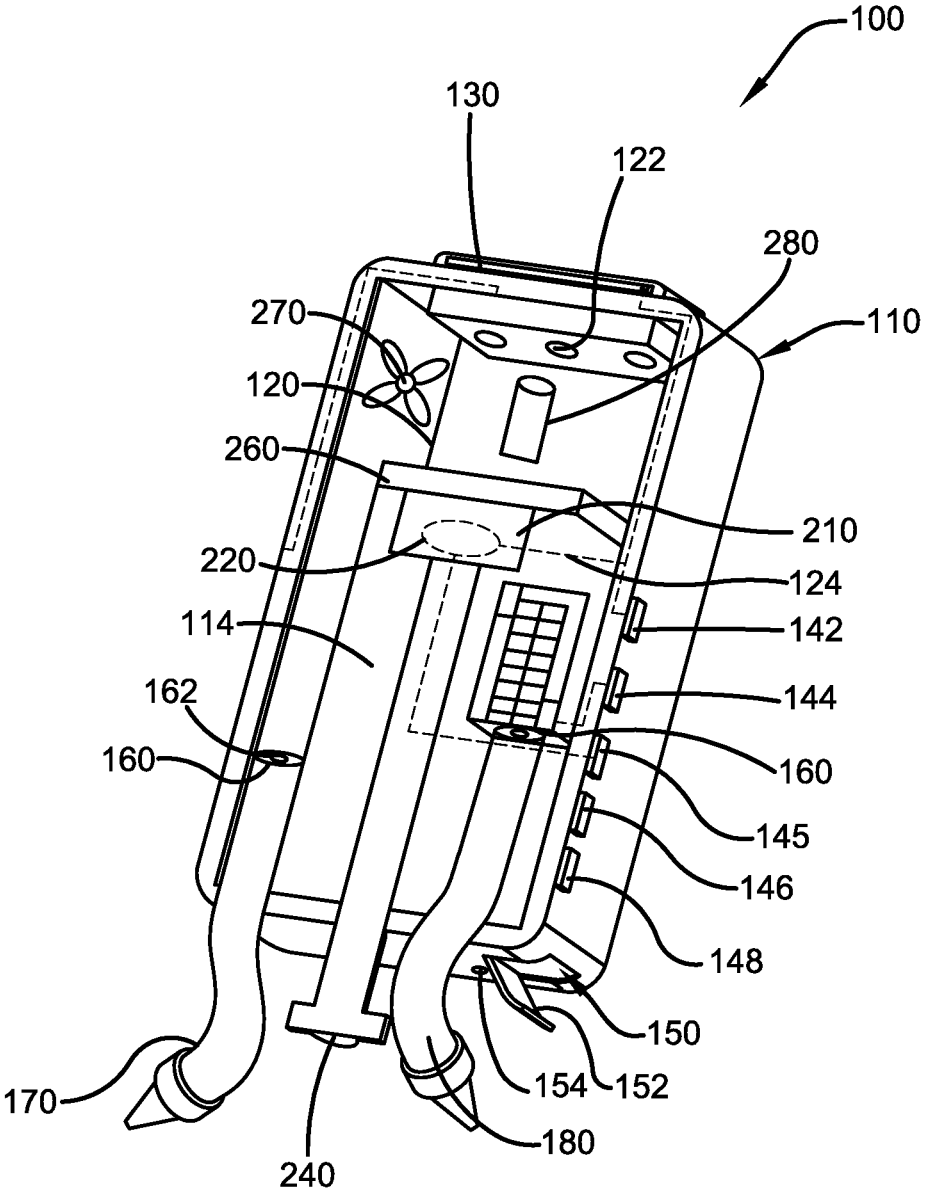
FIG. 1 illustrates a front view of one potential embodiment of a smokeless vaporizer device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an improved smoking device. Further, there exists a long-felt need in the art for a smokeless vaporizer device that eliminates secondhand smoke. In addition, there exists a long-felt need in the art for a smokeless vaporizer device that allows a user to smoke differing smoking substances from the same device.

The present invention, in one exemplary embodiment, is comprised of a smokeless vaporizer device. The device is primarily comprised of a housing with a transparent viewing window, a main reservoir, a CBD vape reservoir, at least one button, an inhale hose, an exhale hose, and at least one battery. The housing is further comprised of a main reservoir that may store any liquid or solid cannabis product, or any vaporizer juice known in the art within the reservoir or within at least one wax tube within the reservoir. The housing further has at least one transparent viewing window that allows a user to view the level of cannabis or vaporizer juice within the reservoir and/or wax tube. In addition, the housing may be comprised of a CBD reservoir that may store any liquid or solid CBD product, or any CBD vaporizer juice known in the art within the reservoir or within at least one wax tube within the reservoir.

Any compound within the main reservoir and/or CBD reservoir may be heated by at least one heating element that is powered by a battery which may be recharged by at least one charging port such as, but not limited to, any USB port type known in the art. To heat a compound, a user presses a heating button followed by pressing a CBD button to direct the heating element to heat a CBD compound within the CBD reservoir. A user may also press a cannabis button to direct the heating element to heat a cannabis compound within the main reservoir. A fan button then allows the CBD compound or cannabis compound to be circulated through the device via at least one fan such that the vaporizer compound can be inhaled via the inhale hose.

The housing is further comprised of at least two rubber seals, wherein each seal may further be comprised of a scented filter to prevent the smell of CBD or cannabis from leaving the housing when the device is used. Each seal receives at least one inhale hose or at least one exhale hose. Both hoses have a mouthpiece that allows a user to inhale vaporizer compounds from the device and exhale said inhaled compounds back into the device via a mouthpiece such that the user produces no secondhand smoke.

Accordingly, the smokeless vaporizer device of the present invention is particularly advantageous as it provides an improved smoking device that eliminates secondhand smoke. In addition, the device allows a user to smoke differing smoking substances from the same device. In this manner, the smokeless vaporizer device overcomes the limitations of existing smoking devices known in the art.

Referring initially to the drawings, FIG. 1 illustrates a front view of one potential embodiment of a smokeless vaporizer device 100 of the present invention in accordance with the disclosed architecture. The device 100 is primarily comprised of a housing 110 with a transparent viewing window 112, a main reservoir 120, a CBD vape reservoir 130, at least one button 140, an inhale hose 170, an exhale hose 180, and at least one battery 250. In the preferred embodiment, the housing 110 is generally rectangular and is preferably manufactured from a durable metal such as, but not limited to, stainless steel or aluminum or a rigid plastic such as, but not limited to: acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, recycled plastic, biodegradable plastic, etc. The device 100 is comprised of at least one (but preferably a plurality of) button 140 that may serve a plurality of functions (142,144,145,146,148) as will be noted more fully below. The button 140 is preferably located on the side surface(s) 118 of the housing 110.

The housing 110 is further comprised of a main reservoir 120. The main reservoir 120 may store any liquid or solid cannabis product or any vaporizer juice known in the art within the reservoir 120 or within at least one wax tube 280 within the reservoir 120. The housing 110 is further comprised of at least one transparent viewing window 112 made from a glass or plastic material. The window 112 is preferably located on a front surface 114 of the housing 110 but may be located anywhere on the housing 110 in differing embodiments. The window 112 allows a user to view the level of cannabis or vaporizer juice within the reservoir 120 and/or wax tube 280. In order to better observe the level of cannabis or vaporizer juice within the reservoir 120, the reservoir 120 may further be comprised of at least one LED 122 that illuminates the reservoir 120. The LED 122 may further be any color in the art and can be controlled by at least one light button 142 located on the housing 110 which allows the LED 122 to be turned on and off. Further, the housing may be comprised of a CBD reservoir 130 that may store any liquid or solid CBD product, or any CBD vaporizer juice known in the art within the reservoir 130 or within at least one wax tube 280 within the reservoir 130.

Any compound within the main reservoir 120 and/or CBD reservoir 130 may be heated by at least one heating element 260. In one embodiment, the heating element 260 is an electric coil that can be heated by at least one battery 250. The battery 250 may be a disposable battery 250 or a rechargeable battery 250 in the form of an alkaline, nickel-cadmium, nickel-metal hydride battery 250, etc., such as any 3V-12 volts DC battery 250 or other conventional battery 250 such as A, AA, AAA, etc., that supply power to the device 100. Throughout this specification the terms "battery" and "batteries" may be used interchangeably to refer to one or more wet or dry cells or batteries 250 of cells in which chemical energy is converted into electricity and used as a source of DC power. References to recharging or replacing batteries 250 may refer to recharging or replacing individual cells, individual batteries 250 of cells, or a package of multiple battery cells as is appropriate for any given battery 250 technology that may be used. Additionally, the battery 250 may be recharged by at least one charging port 230 such as, but not limited to, any USB port type known in the art, wherein the charging port 230 has at least one LED light 232 that illuminates to indicate the battery 250 level of the device 100.

To heat a compound, a user presses the heating button 148 followed by pressing the CBD button 144 to direct the heating element 260 to heat a CBD compound within the CBD reservoir 130. A cannabis button 145 can be pressed to direct the heating element 260 to heat a cannabis compound within the main reservoir 120. A fan button 146 then allows the CBD compound or cannabis compound to be circulated through the device 100 via at least one fan 270 such that the vaporizer compound can be inhaled via the inhale hose 170.

Figure 2:
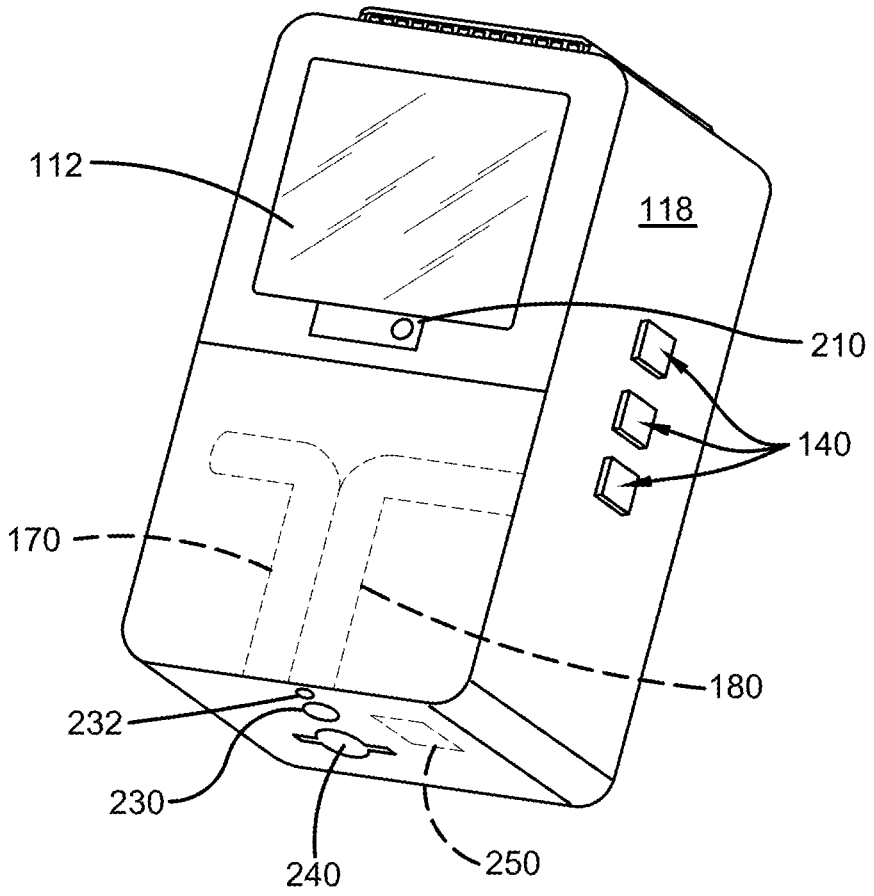
FIG. 2 illustrates a rear view of one potential embodiment of a smokeless vaporizer device of the present invention in accordance with the disclosed architecture.

FIG. 2 illustrates a rear view of one potential embodiment of a smokeless vaporizer device 100 of the present invention in accordance with the disclosed architecture. In one embodiment, cannabis compounds can be placed into the main reservoir 120 via an opening 220 that is covered by a door 210. The door 210 can be opened via a button 140. Additionally, or alternatively, the door 210 can be opened and sealed via a rotatable lever 240 that can be pulled and pushed into the housing 110 as needed to cover and seal or reveal the opening 220.

Cannabis compounds heated within the reservoir 120 are further funneled to an ash collecting compartment 150 within the housing 110 via an internal slope 124 within the housing 110. At least one release knob 154 or other release mechanism can be used to open and securely close an ash release door 152. The ash release door 152 allows heated cannabis compound to be easily removed from the housing 110 and disposed of.

Figure 3:
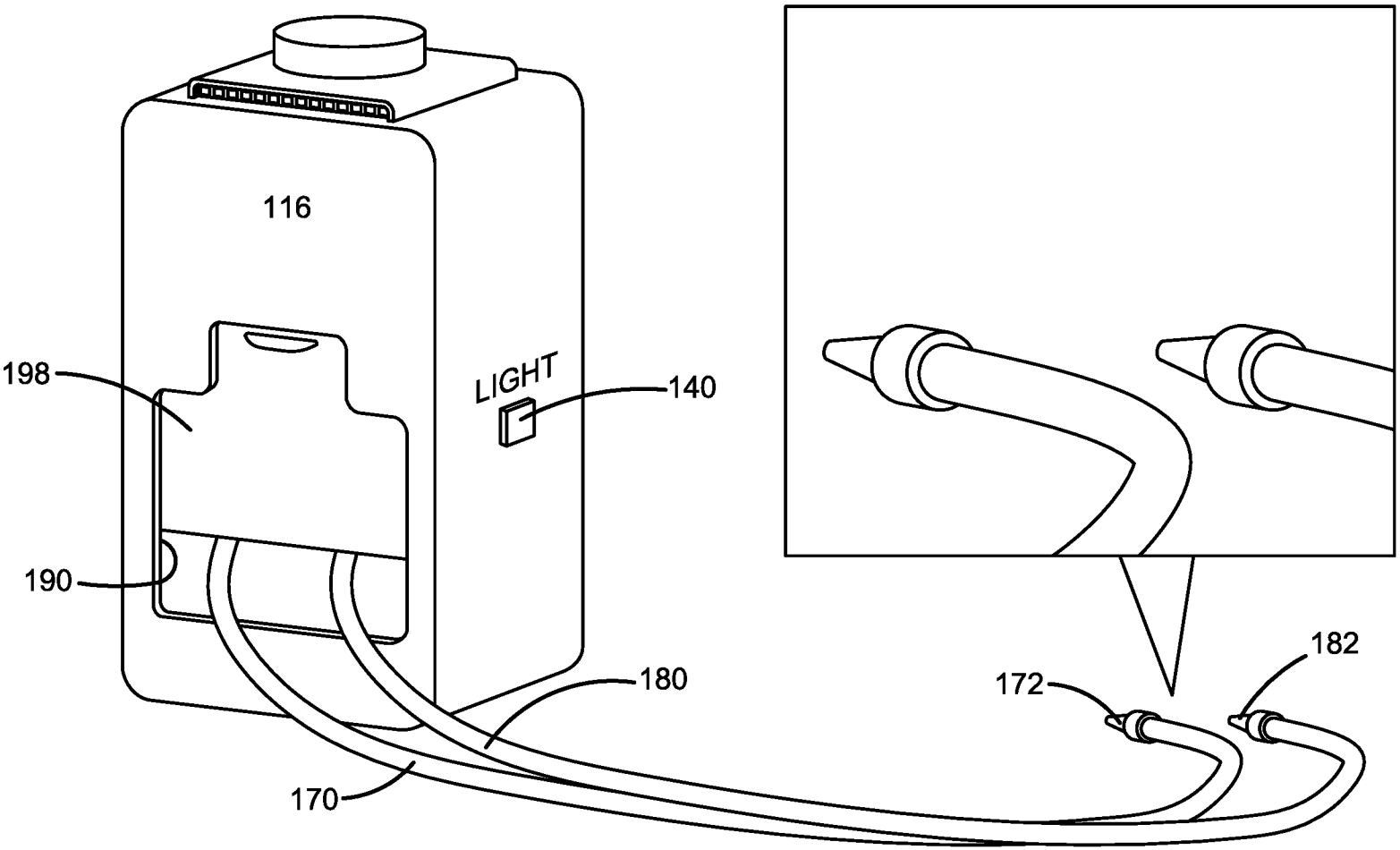
FIG. 3 illustrates a rear view of one potential embodiment of a smokeless vaporizer device of the present invention with the inhale hose and the outlet hose outward from the body in accordance with the disclosed architecture.

The housing 110 is further comprised of at least two rubber seals 160, wherein each seal may further be comprised of a scented filter 162 to prevent the smell of CBD or cannabis from leaving the housing 110 when the device is used. Each seal 160 receives at least one inhale hose 170 or at least one exhale 180 hose, as seen in FIG. 3. The inhale hose 170 has a mouthpiece 172 that allows a user to inhale vaporizer compounds from the device 100. The exhale hose 180 allows a user to exhale said inhaled compounds back into the device 100 via a mouthpiece 182 such that the user produces no secondhand smoke. Both hoses 170,180 can be accessed via a hose opening 190 located on the rear surface 116 and retracted into the housing 110 when not in use. A door 198 further conceals the hose opening 190.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "smokeless vaporizer device" and "device" are interchangeable and refer to the smokeless vaporizer device 100 of the present invention.

Notwithstanding the foregoing, the smokeless vaporizer device 100 of the present invention and its various components can be of any suitable size and configuration as is known in the art without affecting the overall concept of the invention, provided that they accomplish the above-stated objectives. One of ordinary skill in the art will appreciate that the size, configuration and material of the smokeless vaporizer device 100 as shown in the FIGS. are for illustrative purposes only, and that many other sizes and shapes of the smokeless vaporizer device 100 are well within the scope of the present disclosure. Although the dimensions of the smokeless vaporizer device 100 are important design parameters for user convenience, the smokeless vaporizer device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A smokeless vaporizer device comprising:
a housing;
a transparent viewing window;
a main reservoir;
a wax tube positioned in the main reservoir;
a secondary reservoir;
a second wax tube positioned in the secondary reservoir;
a heating element;
a charging port;
a battery;
a fan;
an ash collection compartment;
an LED;
a button;
an inhale hose comprised of a scented filter; and
an exhale hose comprised of a scented filter.

2. The smokeless vaporizer device of claim 1, wherein the LED illuminates the main reservoir.

3. The smokeless vaporizer device of claim 1, wherein the heating element is an electrical coil.

4. The smokeless vaporizer device of claim 1, wherein the charging port is a USB charging port.

5. The smokeless vaporizer device of claim 1, wherein an activation of the button allows the heating element to heat the wax tube within the main reservoir or heat the second wax tube within the secondary reservoir to vaporize a content of either wax tube to produce a vapor.

6. The smokeless vaporizer device of claim 5, wherein the fan circulates the vapor through the smokeless vapor device.

7. The smokeless vaporizer device of claim 1, wherein the inhale hose is further comprised of a mouthpiece.

8. The smokeless vaporizer device of claim 1, wherein the ash collection compartment can be opened and secured via a release knob.

9. The smokeless vaporizer device of claim 1, wherein each of the inhale hose and the exhale hose is concealed by a door.

10. The smokeless vaporizer device of claim 1, wherein each of the inhale hose and the exhale hose can be retracted into the housing.

11. The smokeless vaporizer device of claim 1, wherein each of the inhale hose and the exhale hose each attach to the housing via a rubber seal.

* * * * *